US012059773B2

(12) United States Patent
Coogan et al.

(10) Patent No.: US 12,059,773 B2
(45) Date of Patent: Aug. 13, 2024

(54) RIGID BACKSIZE TO PREVENT FIBER DISC CURLING

(71) Applicants: SAINT-GOBAIN ABRASIVES, INC., Worcester, MA (US); SAINT-GOBAIN ABRASIFS, Conflans-Sainte-Honorine (FR)

(72) Inventors: Timothy Jerome Coogan, West Boylston, MA (US); Jeffrey H. Peet, Southborough, MA (US); Doruk O. Yener, Bedford, MA (US); Charles G. Lester, Saratoga Springs, NY (US); Darrell K. Everts, Schenectady, NY (US); Yunshang Ma, Northborough, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 16/953,427

(22) Filed: Nov. 20, 2020

(65) Prior Publication Data

US 2021/0197342 A1 Jul. 1, 2021

Related U.S. Application Data

(60) Provisional application No. 62/955,918, filed on Dec. 31, 2019.

(51) Int. Cl.
*B24D 11/02* (2006.01)
*B24B 37/22* (2012.01)
(Continued)

(52) U.S. Cl.
CPC ..... *B24D 11/02* (2013.01); *B24B 37/22* (2013.01); *B24B 37/24* (2013.01); *B24D 3/20* (2013.01)

(58) Field of Classification Search
CPC ..... B24D 11/02; B24D 3/20; B24B 37/22; B24B 37/24
See application file for complete search history.

(56) References Cited

U.S. PATENT DOCUMENTS 2,136,150 A 11/1938 Oglesby
2,431,258 A 11/1947 Kirchner
(Continued)

FOREIGN PATENT DOCUMENTS

CN 101966694 B 3/2012
CN 204639971 U 9/2015
(Continued)

OTHER PUBLICATIONS

International Search Report and Written Opinion for PCT/US2020/061415, mailed Mar. 2, 2021, 10 pages.

*Primary Examiner* — Pegah Parvini
(74) *Attorney, Agent, or Firm* — Abel Schillinger, LLP; Arpan Ghosh

(57) ABSTRACT

Systems and methods include providing a coated abrasive article with a substrate formed from a plurality of hygroscopic fibers, an abrasive layer comprising a make coat, a size coat, a supersize coat, or combinations thereof disposed on a first side of substrate, and an anti-curl layer disposed on a second side of the substrate. The polymer-based anti-curl layer allows the coated abrasive article to achieve a change in curl between −5 millimeters and 25 millimeters, the change in curl being expressed as the curl of the coated abrasive article in millimeters at 90% relative humidity minus the curl of the coated abrasive article in millimeters at 20% relative humidity. The coated abrasive article exhib-
(Continued)

its substantially no loss of grinding performance, burst speed, or a combination thereof as compared to coated abrasive articles free of the anti-curl layer.

17 Claims, 7 Drawing Sheets

(51) Int. Cl.
*B24B 37/24* (2012.01)
*B24D 3/20* (2006.01)

(56) References Cited

U.S. PATENT DOCUMENTS

| | | | |
|---|---|---|---|
| 2,485,765 | A | 10/1949 | Oglesby |
| 2,492,143 | A | 12/1949 | Gipple et al. |
| 2,534,805 | A | 12/1950 | Waterfield |
| 4,084,941 | A | 4/1978 | Cox et al. |
| 4,225,321 | A | 9/1980 | Swiatek |
| 4,642,126 | A | 2/1987 | Zador et al. |
| 4,735,632 | A | 4/1988 | Oxman et al. |
| 4,871,376 | A | 10/1989 | DeWald |
| 4,979,612 | A | 12/1990 | Melbye |
| 5,221,291 | A | 6/1993 | Imatani et al. |
| 5,316,812 | A | 5/1994 | Stout et al. |
| 5,456,975 | A | 10/1995 | Zador et al. |
| 5,486,219 | A | 1/1996 | Ford et al. |
| 5,497,877 | A | 3/1996 | Ali et al. |
| 5,582,625 | A | 12/1996 | Wright et al. |
| 5,669,941 | A | 9/1997 | Peterson |
| 5,849,646 | A | 12/1998 | Stout et al. |
| 6,197,076 | B1 | 3/2001 | Braunschweig et al. |
| 6,432,549 | B1 | 8/2002 | Kronzer |
| 7,040,973 | B1 | 5/2006 | Kitts |
| 10,046,439 | B2 | 8/2018 | Wendt-Ginsberg |
| 2002/0168487 | A1 | 11/2002 | Johnson |
| 2002/0177391 | A1 | 11/2002 | Fritz et al. |
| 2003/0079415 | A1 | 5/2003 | Carter et al. |
| 2003/0163957 | A1 | 9/2003 | Chen |
| 2003/0176156 | A1 | 9/2003 | Braunschweig et al. |
| 2004/0029511 | A1* | 2/2004 | Kincaid ..... C08F 283/10 451/526 |
| 2005/0120636 | A1 | 6/2005 | Kim |
| 2006/0143989 | A1 | 7/2006 | Lindquist et al. |
| 2006/0265966 | A1 | 11/2006 | Rostal et al. |
| 2006/0265967 | A1 | 11/2006 | Follensbee et al. |
| 2009/0325466 | A1* | 12/2009 | Kincaid ..... B24D 3/20 451/28 |
| 2012/0000135 | A1 | 1/2012 | Eilers et al. |
| 2014/0308884 | A1 | 10/2014 | Janssen et al. |
| 2015/0126098 | A1 | 5/2015 | Eilers et al. |
| 2015/0306739 | A1 | 10/2015 | Vervacke |
| 2016/0074998 | A1 | 3/2016 | Sharmila et al. |

FOREIGN PATENT DOCUMENTS

| | | | |
|---|---|---|---|
| GB | 670676 | A | 4/1952 |
| GB | 1575972 | A | 10/1980 |
| KR | 1020170034131 | A | 3/2017 |
| WO | 9735687 | A1 | 10/1997 |
| WO | 0015389 | A2 | 3/2000 |
| WO | 2016209651 | A1 | 12/2016 |

* cited by examiner

RIGID BACKSIZE TO PREVENT FIBER DISC CURLING

CROSS-REFERENCE TO RELATED APPLICATION(S)

This application claims priority under 35 U.S.C. § 119(e) to of U.S. Provisional Application No. 62/955,918, entitled "RIGID BACKSIZE TO PREVENT FIBER DISC CURLING," by Timothy Jerome COOGAN et al., filed Dec. 31, 2019, which is assigned to the current assignee hereof and incorporated herein by reference in its entirety.

BACKGROUND OF THE INVENTION

Abrasive articles, such as coated abrasives, are used in various industries to prepare and condition workpieces by lapping, grinding, and polishing to achieve a desired condition (e.g., coating removal, material removal, surface roughness, gloss, transparency, etc.) of the workpiece. Such coated abrasive articles can be used in processing a wide range of materials from initial coarse material removal to high precision polishing and finishing surfaces at a submicron level. The formulation of various layers in these abrasive articles can be tailored to achieve desired aesthetic and/or performance results.

SUMMARY

The present disclosure relates generally to coated abrasive articles that include a substrate comprising a plurality of hygroscopic fibers, an abrasive layer comprising a make coat, a size coat, a supersize coat, or combinations thereof disposed on a first side of substrate, and a polymeric (or polymer-based) anti-curl layer disposed on a second side of the substrate to reduce or altogether eliminate curl in the abrasive article. The anti-curl layer allows the coated abrasive article to achieve a change in curl between−5 millimeters and 25 millimeters, the change in curl being expressed as the curl of the coated abrasive article in millimeters at 90% relative humidity minus the curl of the coated abrasive article in millimeters at 20% relative humidity. The coated abrasive article exhibits substantially no loss of grinding performance, burst speed, or a combination thereof as compared to coated abrasive articles free of the anti-curl layer.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope, as there may be other equally effective embodiments.

The use of the same reference symbols in different drawings indicates similar or identical items.

DETAILED DESCRIPTION

Abrasive Article

Figure 1A:
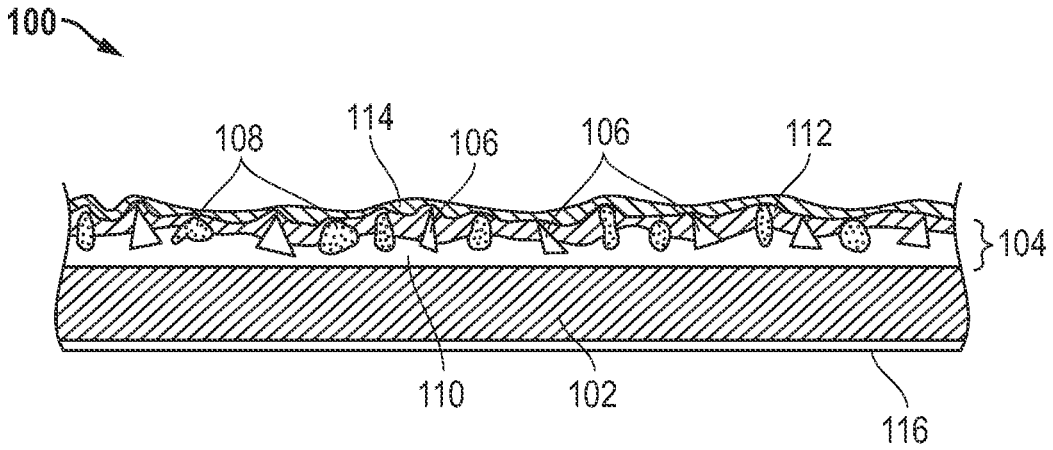
FIG. 1A is a cross sectional view of a coated abrasive article according to an embodiment of the disclosure.

FIG. 1A shows a cross sectional view of a coated abrasive article 100 according to an embodiment of the disclosure. The coated abrasive article 100 may generally comprise a substrate (also referred to herein as a "backing material" or "backing") 102. The substrate 102 may comprise a first major surface or side on which an abrasive layer 104 may be disposed. The abrasive layer 104 may include abrasive grains or particles 106 and/or aggregates 108 disposed at least partially in or on a polymeric make coat binder composition (commonly referred to as the "make coat") 110. In some embodiments, the abrasive layer 104 may also comprise a polymeric size coat binder composition (commonly referred to as the "size coat") 112 disposed over the abrasive particles 106, the aggregates 108, and the make coat 110. Additionally, in some embodiments, a polymeric supersize coat binder composition (commonly referred to as the "supersize coat") 114 may be disposed over the abrasive layer 104 and the size coat 112. Furthermore, in some embodiments, the coated abrasive article 100 may also comprise an anti-curl layer 116. The substrate 102 may comprise a second major surface or side, opposite from the first major surface or side, on which the polymeric (or polymer-based) anti-curl layer 116 (commonly referred to as the "backsize coat") may be disposed.

In some embodiments, the abrasive article 100 may be a fixed abrasive article. Fixed abrasive articles may include coated abrasive articles, bonded abrasive articles, nonwoven abrasive articles, engineered abrasive articles, and combinations thereof. Abrasive articles, such as abrasive article 100, may be in the form of sheets, discs, belts, tapes, wheels, thin wheels, flap wheels, flap discs, polishing films, and the like. In an alternative embodiment, the abrasive article 100 may be a coated abrasive article comprising a substrate 102, a make coat 110 disposed on the substrate 102, and abrasive particles 106 and/or composite abrasive aggregates 108 disposed on or in the make coat 110. Additionally, in some embodiments, the abrasive article 100 may comprise an anti-curl layer 116.

Substrate

The substrate (also referred to herein as a "backing material" or "backing") 102 may be flexible or rigid. The substrate 102 may be formed from any number of various materials including those conventionally used as backings in the manufacture of coated abrasives. In some embodiments, the substrate 102 may be formed from a plurality of hygroscopic fibers. More specifically, in some embodiments, the substrate 102 may be formed from a plurality of hygroscopic cellulosic fibers. In some embodiments, the plurality of hygroscopic fibers may comprise vulcanized fibers, leatheroid, or a combination thereof. Further, in particular embodiments, the vulcanized fibers may comprise Commercial Grade vulcanized fibers, Electrical Grade vulcanized fibers, Trunk Grade vulcanized fibers, Bone Grade vulcanized fibers, Wood Laminating Grade vulcanized fibers, or any combination thereof. Still further, it will be appreciated that the substrate 102 may generally be free of a reinforcing material. In a specific embodiment, the substrate 102 may comprise a vulcanized fiber disc.

In some embodiments, the substrate 102 may comprise a thickness. In some embodiments, the thickness of the substrate 102 may be at least 0.60 millimeters, at least 0.65 millimeters, at least 0.70 millimeters, at least 0.75 millimeters, at least 0.80 millimeters, at least 0.85 millimeters, at least 0.90 millimeters, or at least 0.95 millimeters. In some embodiments, the thickness of the substrate 102 may be not greater than 2.00 millimeters, not greater than 1.50 millimeters, not greater than 1.40 millimeters, not greater than 1.30 millimeters, not greater than 1.20 millimeters, not greater than 1.10 millimeters, or not greater than 1.00 millimeters. Further, the thickness of the substrate 102 may be between any of these minimum and maximum values, such as at least 0.60 millimeters to not greater than 2.00 millimeters.

In some embodiments, the abrasive layer 104 may also comprise a thickness. In some embodiments, the thickness of the substrate 102 may be at least 100%, at least 300%, or at least 500% of the thickness of the abrasive layer 104. In some embodiments, the thickness of the substrate 102 may be not greater than 800%, not greater than 700%, not greater than 600%, or not greater than 5000% of the thickness of the abrasive layer 104. Further, the thickness of the substrate 102 may be between any of these minimum and maximum values, such as at least 200% to not greater than 600% or at least 300% to not greater than 550% of the thickness of the abrasive layer 104.

Abrasive Layer and Particles

The abrasive layer 104 may include abrasive grains or particles 106 and/or aggregates 108 disposed at least partially in or on the make coat 110. In some embodiments, the abrasive layer 104 may also comprise the size coat 112 disposed over the abrasive particles 106 and/or aggregates 108 and the make coat 110. Abrasive particles 106 may include essentially single-phase inorganic materials, such as alumina, silicon carbide, silica, ceria, and/or harder, high performance superabrasive particles such as cubic boron nitride and diamond. Further, the abrasive particles 106 may include engineered abrasives including macrostructures and particular three-dimensional structures. Aggregates 108 may comprise abrasive aggregates and/or nonabrasive aggregates. In some embodiments, aggregates 108 may include composite particulate materials, which can be formed through slurry processing pathways that include removal of the liquid carrier through volatilization or evaporation, leaving behind unfired ("green") aggregates 108, that can optionally undergo high temperature treatment (i.e., firing, sintering) to form usable, fired aggregates 108.

The abrasive particles 106 and/or aggregates 108 may be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive particles 106 and/or aggregates 108 may be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles 106 comprised principally of alpha-alumina.

In particular embodiments, the abrasive particles 106 and/or aggregates 108 may be blended with the binder formulation to form abrasive slurry. Alternatively, the abrasive particles 106 and/or aggregates 108 may be applied over the make coat 110 after the make coat 110 is applied to the substrate 102. Optionally, a functional powder can be applied over the abrasive regions to prevent the abrasive regions from sticking to a patterning tooling. Alternatively, patterns can be formed in the abrasive regions absent the functional powder.

Make Coat

The polymeric make coat binder composition 110 (commonly referred to as the "make coat") may be formed from a single polymer or a blend of polymers. The make coat 110 may be formed from an epoxy composition, acrylic composition, a phenolic composition, a polyurethane composition, a urea formaldehyde composition, a polysiloxane composition, or combinations thereof. In some embodiments, the make coat 110 may generally include a polymer matrix, which binds abrasive particles 106 and/or aggregates 108 to the substrate 102 or to a compliant coat, if such a compliant coat is present. In some embodiments, the make coat 110 may be formed of cured binder formulation. In specific embodiments, the make coat 110 may comprise a polymeric binder comprising phenol formaldehyde, urea formaldehyde, UV-curable polymers, epoxy, acrylic, unsaturated polyester, or any combination thereof. Additionally, in some embodiments, the make coat 110 may include one or more additives.

In some embodiments, the make coat 110 may include at least one polymer component and a dispersed phase. The make coat 110 may include one or more reaction constituents or polymer constituents for the preparation of a polymer. Suitable polymer constituents may include a monomeric molecule, an oligomeric molecule, a polymeric molecule, or a combination thereof. Further, the make coat 110 may further comprise components selected from the group consisting of solvents, plasticizers, chain transfer agents, catalysts, stabilizers, dispersants, curing agents, defoamers, reaction mediators and agents for influencing the fluidity of the dispersion. Accordingly, in some embodiments, the polymer constituents may form thermoplastics or thermosets.

Size Coat

The polymeric size coat binder composition 112 (commonly referred to as the "size coat") may generally be a component of the abrasive layer 104 and be disposed over the abrasive particles 106, the aggregates 108, and the make coat 110. The size coat 112 may be formed in a substantially similar manner as the make coat 110. Thus, in some embodiments, the size coat 112 may be the same or different from the make coat 110. Further, size coat 112 may comprise any conventional compositions known in the art that can be used as a size coat. Still further, in some embodiments, the size coat 112 may include may include an anti-loading composition, one or more additives or grinding aids, or a combination thereof.

Supersize Coat

The polymeric supersize coat binder composition 114 (commonly referred to as the "supersize coat") may generally be disposed over the abrasive layer 104, more specifically, the abrasive particles 106, the aggregates 108, the make coat 110, and the size coat 112. In some embodiments, the supersize coat 114 may be formed in a substantially similar manner as the make coat 110 and/or the size coat 112. Additionally, in some embodiments, the supersize coat 114 may comprise an enhanced anti-loading composition. However, in some embodiments, the supersize coat 114 may comprise the enhanced anti-loading composition disposed a least partially on or in (e.g., dispersed in) the supersize coat 114. Further, at least in some embodiments, the supersize coat 114 may comprise one or more additives in addition to the anti-loading composition.

In some embodiments, the abrasive layer 104 may be applied to the first side of the substrate 102 and comprise a weight. In some embodiments, the weight of the abrasive layer 104 may be at least 20 lb./ream, at least 30 lb./ream, at least 40 lb./ream, at least 50 lb./ream, at least 60 lb./ream, or at least 70 lb./ream. In some embodiments, the weight of the abrasive layer 104 may be not greater than 110 lb./ream, 90 lb./ream, 80 lb./ream, or 70 lb./ream. Further, the weight of the abrasive layer 104 may be between any of these minimum and maximum values, such as at least 20 lb./ream to not greater than 110 lb./ream. It will be appreciated that in some embodiments, lower weights of the abrasive layer 104 may be suitable for abrasive articles 100 having finer grit, while heavier weights of the abrasive layer 104 may be suitable for abrasive articles 100 having coarser grit.

Anti-Curl Layer

Figure 1B:
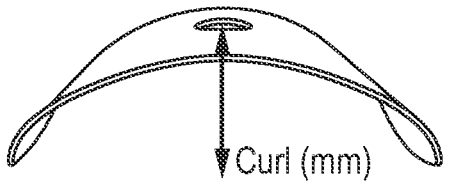
FIG. 1B is an image showing curl of a coated abrasive article.

The anti-curl layer 116 may generally be applied to the second side of the substrate 102. The anti-curl layer 102 may be configured to decrease the change in curl of the abrasive article 100 resulting from changes in relative humidity. FIG. 1B is an image showing the curl of a coated abrasive article 100. As shown in FIG. 1B, the curl of a coated abrasive article 100 may be defined by the deviation of outer edges of the coated abrasive article 100 from a perfectly flat surface. In some instances, curl may be caused by changes in environmental humidity levels which cause a substrate 102 formed from hygroscopic cellulosic fibers to expand or contract due to a gain or loss in moisture, thereby generating stress in the fibers. In some instances, curl may also be caused by stress relaxation, which is a phenomenon that occurs in all viscoelastic materials, such as hygroscopic cellulosic fibers. In some embodiments, the anti-curl layer 116 may comprise phenol formaldehyde, urea formaldehyde, UV-curable polymers, epoxy, acrylic, unsaturated polyester, latex suspensions, or a combination thereof. In a specific embodiment, the anti-curl layer 116 consists essentially of phenol formaldehyde. In another specific embodiment, the anti-curl layer 116 consists essentially of urea formaldehyde.

In some embodiments, the anti-curl layer 116 may generally be applied to the second side of the substrate 102 and comprise a weight. In some embodiments, the anti-curl layer 116 may comprise a weight of at least 5.0 lb./ream, at least 6.0 lb./ream, at least 7.0 lb./ream, at least 8.0 lb./ream, at least 9.0 lb./ream, at least 10.0 lb./ream, at least 11.0 lb./ream, at least 12.0 lb./ream, at least 13.0 lb./ream, at least 14.0 lb./ream, at least 15.0 lb./ream, or at least 16.0 lb./ream. In some embodiments, the anti-curl layer 116 may comprise a weight of not greater than 25.0 lb./ream, not greater than 24.0 lb./ream, not greater than 23.0 lb./ream, not greater than 22.0 lb./ream, not greater than 21.0 lb./ream, or not greater than 20.0 lb./ream. Further, the anti-curl layer 116 may comprise a weight between any of these minimum and maximum values, such as at least 5.0 lb./ream to not greater than 20.0 lb./ream.

The anti-curl layer 116 may also comprise a thickness. In some embodiments, the anti-curl layer 116 may comprise a thickness of at least 0.03 millimeters, at least 0.04 millimeters, at least 0.05 millimeters, at least 0.06 millimeters, at least 0.07 millimeters, or at least 0.075 millimeters. In some embodiments, the anti-curl layer 116 may comprise a thickness of not greater than 0.2 millimeters, not greater than 0.15 millimeters, not greater than 0.14 millimeters, not greater than 0.13 millimeters, not greater than 0.12 millimeters, not greater than 0.11 millimeters, not greater than 0.10 millimeters, or not greater than 0.095 millimeters. Further, the anti-curl layer 116 may comprise a thickness between any of these minimum and maximum values, such as at least 0.03 millimeters to not greater than 0.20 millimeters.

In a specific embodiment, the anti-curl layer 116 may comprise phenol formaldehyde and comprise a thickness of at least 0.03 millimeters to not greater than 0.06 millimeters. In some embodiments, the abrasive layer 104 may comprise a weight of phenol formaldehyde polymer, the anti-curl layer 116 may comprise a weight of phenol formaldehyde polymer, and the ratio of the weight of the phenol formaldehyde polymer of the anti-curl layer 116 may be at least 8% to not greater than 45% or at least 16% to not greater than 25% of the weight of the phenol formaldehyde polymer of the abrasive layer 104. In another specific embodiment, the anti-curl layer 116 may comprise urea formaldehyde and comprise a thickness of at least 0.07 millimeters to not greater than 0.175 millimeters. In some embodiments, the abrasive layer 104 may comprise a weight of phenol formaldehyde polymer, the anti-curl layer 116 may comprise a weight of urea formaldehyde polymer, and the ratio of the weight of the urea formaldehyde polymer of the anti-curl layer 116 is at least 10% to not greater than 100% or at least 15% to not greater than 60% of the weight of the phenol formaldehyde polymer of the abrasive layer 104. In some embodiments, the abrasive layer 104 may comprise a total weight, the anti-curl layer 116 may comprise a total weight, and the ratio of the total weight of the anti-curl layer 116 is at least 3% to not greater than 35%, at least 5% to not greater than 30%, or at least 8% to not greater than 20% of the total weight of the total abrasive layer 104.

In some embodiments, the anti-curl layer 116 may reduce the change in curl of a coated abrasive article 100. Change in curl may generally be defined as the curl of the coated abrasive article 100 in millimeters at 90% relative humidity minus the curl of the coated abrasive article 100 in millimeters at 20% relative humidity. In some embodiments, the anti-curl layer 116 may provide the coated abrasive article 100 with change in curl of at least −5 millimeters, at least 0 millimeters, at least 5 millimeters, or at least 10 millimeters. In some embodiments, the change in curl the anti-curl layer 116 may provide the coated abrasive article 100 with change in curl of not greater than 30 millimeters, not greater than 25 millimeters, or not greater than 20 millimeters. Further, it will be appreciated that the anti-curl layer 116 may provide the coated abrasive article 100 with change in curl between any of these minimum and maximum values, such as at least −5 millimeters to not greater than 25 millimeters, or even at least 0 millimeters to not greater than 20 millimeters.

Furthermore, it will be appreciated that the anti-curl layer 116 may reduce the normalized change in curl percentage of the coated abrasive article 100. The normalized change in curl percentage may generally be defined as the ratio of the change in curl to the diameter of the coated abrasive article 100, and the change in curl may generally still be defined as the curl of the coated abrasive article in millimeters at 90% relative humidity minus the curl of the coated abrasive article in millimeters at 20% relative humidity. In some embodiments, the anti-curl layer 116 may provide the coated abrasive article 100 with a normalized change in curl percentage of at least −2.8%, at least 0.0%, at least 2.8%, or at least 5.6%. In some embodiments, the anti-curl layer 116 may provide the coated abrasive article 100 with a normalized change in curl percentage not greater than 16.9%, not greater than 14.1%, or not greater than 11.3%. Further, it will be appreciated that the anti-curl layer 116 may provide the coated abrasive article 100 with a normalized change in curl percentage between any of these minimum and maximum values, such as at least −3.6% to not greater than 17.9%, or even at least 0.0% to not greater than 14.3%.

Additives

The make coat 110, size coat 112, and/or supersize coat 114 may include one or more additives. The anti-curl layer 116 may be free of any additive or additional reinforcing material, or alternatively, the anti-curl layer may include one or more additives. Suitable additives can include grinding aids, fibers, lubricants, wetting agents, chelating agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. In a particular embodiment, the additive may comprise Calcium Sulfate (CaSO 4), Talc, wollastonite, calcium carbonate, or a combination thereof. The amounts of these additive materials can be selected to provide the properties desired. These optional additives can be present in any part of the overall system of the coated abrasive product according to embodiments of the present disclosure. Suitable grinding aids can be inorganic based; such as halide salts, cryolite, wollastonite, alumina trihydrate, and potassium fluoroborate (KBF 4), or organic based, such as sodium lauryl sulphate, or chlorinated waxes, such as polyvinyl chloride. In an embodiment, the grinding aid can be an environmentally sustainable material.

Method of Forming a Coated Abrasive Article

Figure 2:
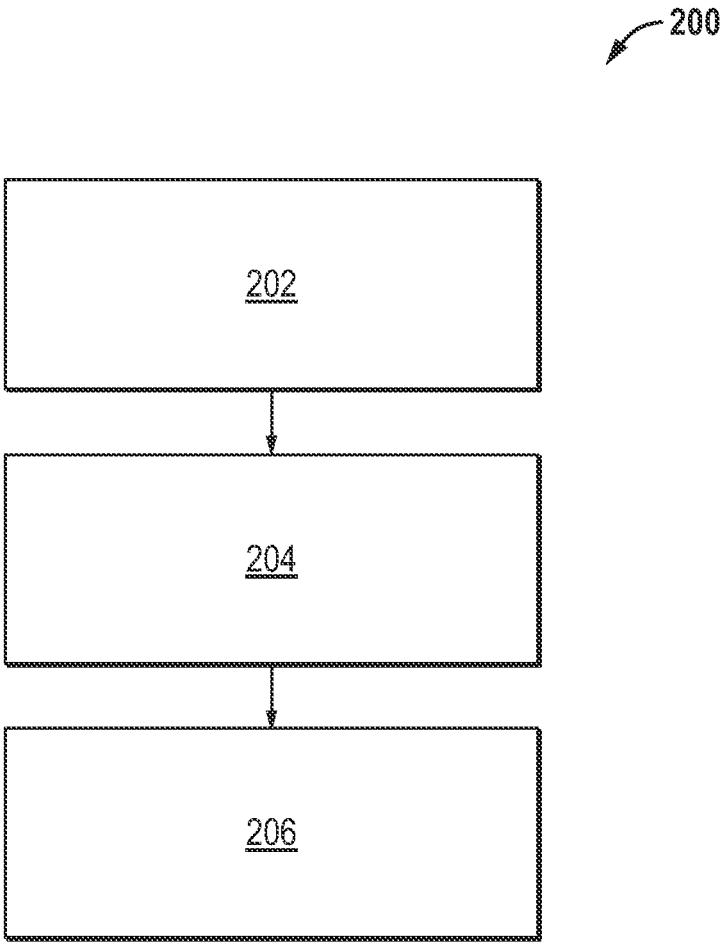
FIG. 2 is a flowchart of a method of forming a coated abrasive article according to an embodiment of the disclosure.

FIG. 2 shows a flowchart of a method 200 of forming a coated abrasive article 100 according to an embodiment of the disclosure. Method 200 begins at block 202 by forming a substrate 102 from a plurality of hygroscopic fibers. Method 200 may continue at block 204 by disposing an abrasive layer 104 on a first side of the substrate 102. Method 200 may continue at block 206 by disposing an anti-curl layer 116 on a second side of the substrate 116, wherein the coated abrasive article comprises a change in curl of not less than −5 millimeters to not greater than 25 millimeters, wherein the change in curl is expressed as the curl of the coated abrasive article in millimeters at 90% relative humidity minus the curl of the coated abrasive article in millimeters at 20% relative humidity.

Figure 3:
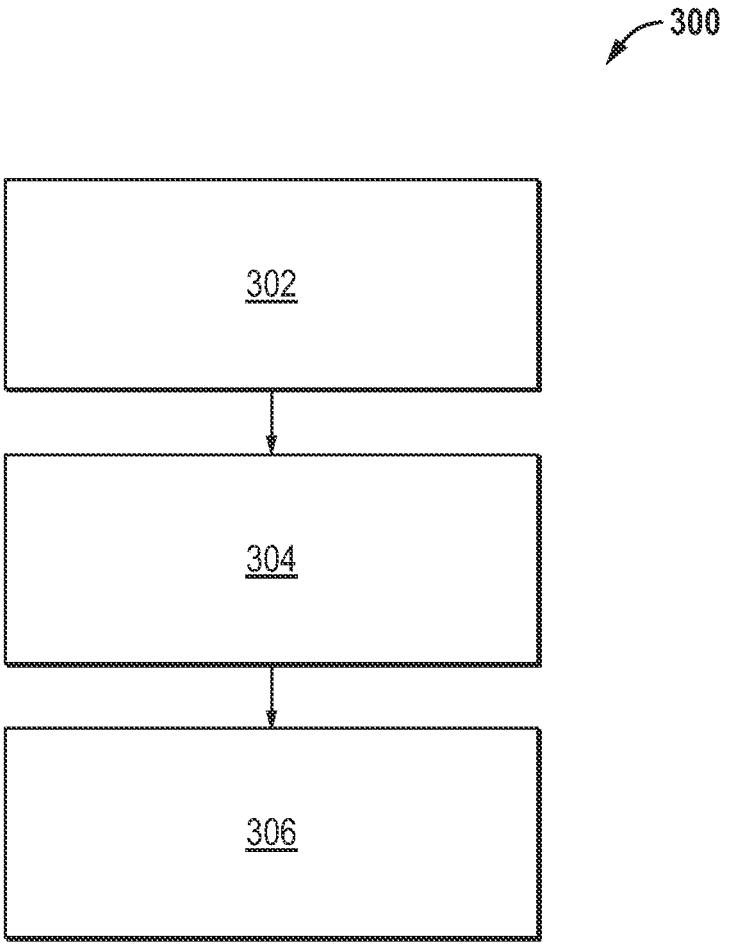
FIG. 3 is a flowchart of a method of forming a coated abrasive article according to another embodiment of the disclosure.

FIG. 3 shows a flowchart of a method 300 of forming a coated abrasive article 100 according to another embodiment of the disclosure. Method 300 begins at block 302 by forming a substrate 102 from a plurality of hygroscopic fibers. Method 300 may continue at block 304 by disposing an anti-curl layer 116 on a first side of the substrate 102. Method 300 may continue at block 306 by disposing an abrasive layer 104 on a second side of the substrate 102, wherein the coated abrasive article comprises a change in curl of not less than −5 millimeters to not greater than 25 millimeters, wherein the change in curl is expressed as the curl of the coated abrasive article in millimeters at 90% relative humidity minus the curl of the coated abrasive article in millimeters at 20% relative humidity.

Examples

Sample abrasive articles 100 utilizing phenol formaldehyde (PF) formulations and urea formaldehyde (UF) in an anti-curl layer 116 were prepared. The uncured anti-loading compositions are shown in Table 1 below.

TABLE 1

| Uncured Compositions Wet Formulation | | | | |
|---|---|---|---|---|
| | UF Back Size | PF Back Size | Make Coat | Size Coat |
| wt. % UF resin | 50.58 | 0.00 | 0.00 | 0.00 |
| wt. % PF resin | 0.00 | 36.72 | 38.60 | 27.96-36.06 |
| wt. % wollastonite | 0.00 | 45.90 | 48.25 | 0.00 |
| wt. % calcium sulfate | 23.30 | 0.00 | 0.00 | 0.00 |
| wt. % cryolite | 0.00 | 0.00 | 0.00 | 37.64-38.39 |
| wt. % KBF4 | 0.00 | 0.00 | 0.00 | 0.00-16.16 |
| wt. % fumed silica | 0.00 | 0.00 | 0.00 | 0.10-0.20 |
| wt. % reaction inhibitor | 0.40 | 0.00 | 0.00 | 0.00 |
| wt. % wetting (dispersing) agent | 0.30 | 0.42 | 0.44 | 0.78-0.80 |
| wt. % defoamer | 0.00 | 0.14 | 0.15 | 0.10-0.11 |
| wt. % reaction catalyst | 0.68 | 0.00 | 0.00 | 0.00 |
| wt. % pigment | 0.00 | 0.00 | 0.00 | 2.29-4.87 |
| wt. % water | 24.75 | 16.78 | 12.56 | 15.06-19.57 |
| Total % | 100.0 | 100.0 | 100.0 | 100.0 |
| % solids | 75.3 | 83.2 | 87.4 | 80.43-84.90 |

The cured anti-loading compositions for sample abrasive articles 100 are shown in Table 2 below.

TABLE 2

| | Cured Compositions Dry Formulation | | | |
|---|---|---|---|---|
| | UF Back Size | PF Back Size | Make Coat | Size Coat |
| wt. % UF resin | 67.21 | 0.00 | 0.00 | 0.00 |
| wt. % PF resin | 0.00 | 44.13 | 44.14 | 32.91-44.83 |
| wt. % wollastonite | 0.00 | 55.16 | 55.18 | 0.00 |
| wt. % calcium sulfate | 30.96 | 0.00 | 0.00 | 0.00 |
| wt. % cryolite | 0.00 | 0.00 | 0.00 | 44.31-47.73 |
| wt. % KBF4 | 0.00 | 0.00 | 0.00 | 0.00-19.02 |
| wt. % fumed silica | 0.00 | 0.00 | 0.00 | 0.12-0.25 |
| wt. % reaction inhibitor | 0.53 | 0.00 | 0.00 | 0.00 |
| wt. % wetting (dispersing) agent | 0.40 | 0.50 | 0.50 | 0.92-0.99 |
| wt. % defoamer | 0.00 | 0.17 | 0.17 | 0.12-0.14 |
| wt. % reaction catalyst | 0.90 | 0.00 | 0.00 | 0.00 |
| wt. % pigment | 0.00 | 0.00 | 0.00 | 2.70-6.06 |
| wt. % water | 0.00 | 0.00 | 0.00 | 0.00 |
| Total % | 100.0 | 100.0 | 100.0 | 100.0 |
| % solids | 100.0 | 100.0 | 100.0 | 100.0 |

Figure 4:
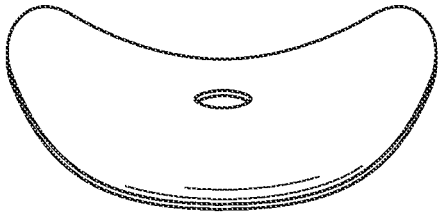
FIG. 4 is an image of a coated abrasive article having a negative curl value.
Figure 5:
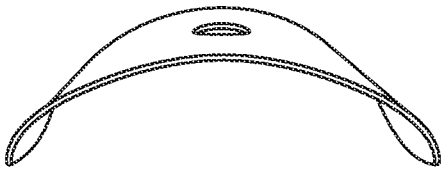
FIG. 5 is an image of a coated abrasive article having a positive curl value.
Figure 6:
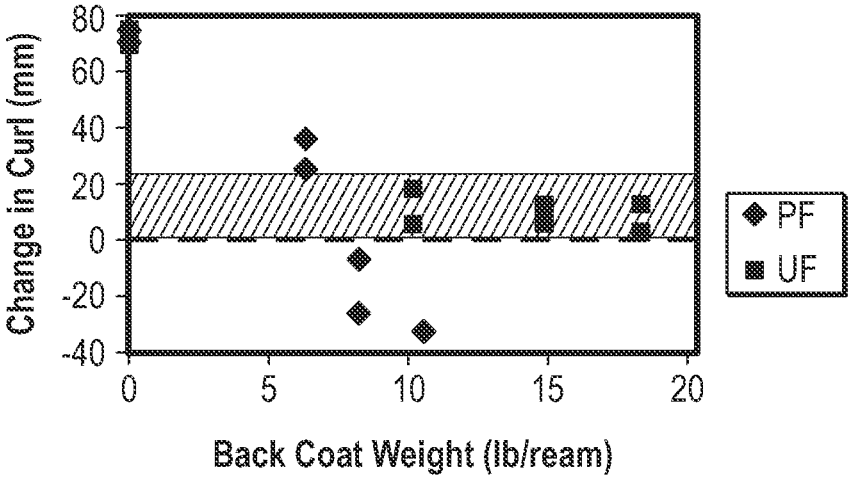
FIG. 6 is a chart providing comparative data of change in curl of embodiments of coated abrasive articles of the disclosure.
Figure 7:
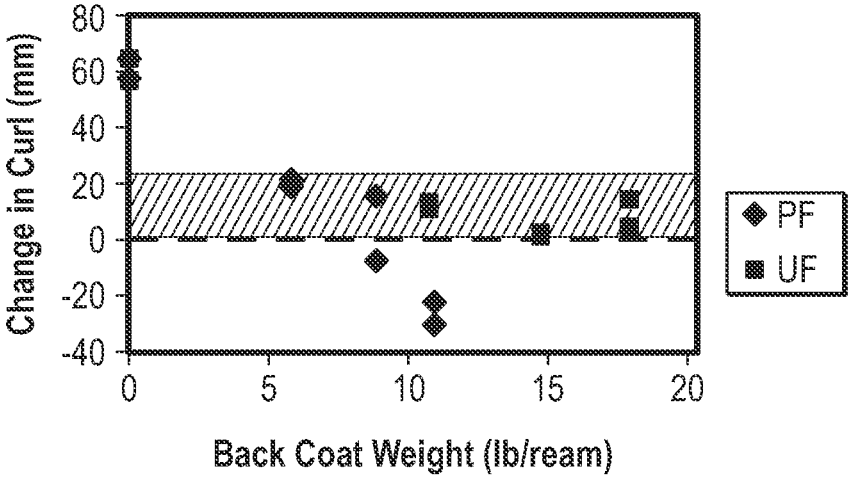
FIG. 7 is a chart providing comparative data of change in curl of embodiments of coated abrasive articles of the disclosure.

The sample coated abrasive articles 100 were produced and tested to measure the change in curl. FIG. 4 shows an image of a coated abrasive article 100 having a negative curl value. As shown, a negative curl value indicates the coated abrasive article 100 curls upwards, where the abrasive layer 104 comprises a concave profile. This is the most undesirable curl configuration. FIG. 5 shows an image of a coated abrasive article 100 having a positive curl value. As shown, a positive curl value indicates the coated abrasive article 100 curls downwards, where the abrasive layer 104 comprises a convex profile. Change in curl is expressed as the curl of the coated abrasive article 100 in millimeters at 90% relative humidity minus the curl of the coated abrasive article 100 in millimeters at 20% relative humidity. Thus, change in curl is an effective metric for quantifying an abrasive article's sensitivity to changes in moisture. The results are shown in FIG. 6 (0.60 mm fiber thickness) and 7 (0.85 mm fiber thickness). Surprisingly and beneficially, application of the anti-curl layer 116 to the coated abrasive article reduces change in curl, and in some instances altogether eliminates curl. However, in some instances, the application of too much weight of the anti-curl layer 116 can introduce curl by inverting the direction of curl, which is undesirable. As such, it will be appreciated that in some embodiments, a change in curl between−5 millimeters and 25 millimeters may be desirable. In other embodiments, a change in curl between 0 millimeters and 20 millimeters may be desirable.

Figure 8:
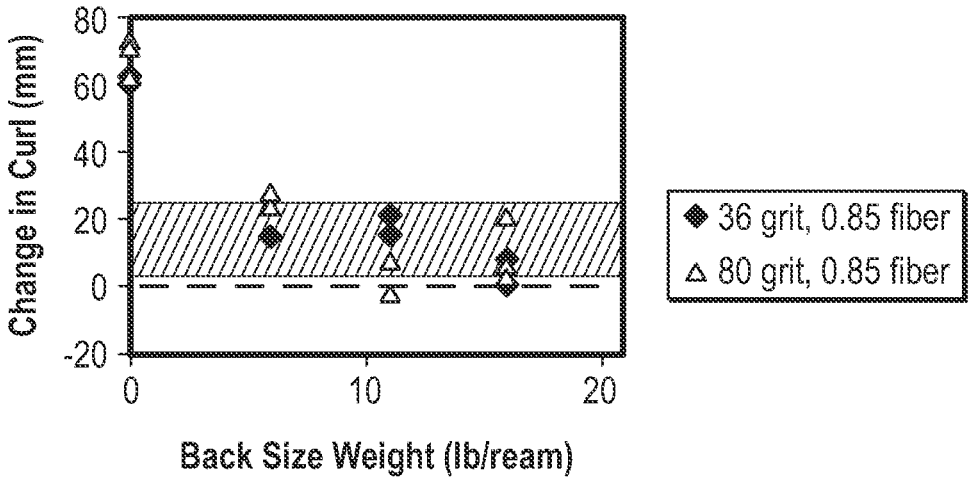
FIG. 8 is a chart providing comparative data of change in curl of embodiments of coated abrasive articles of the disclosure.

FIG. 8 shows a chart providing comparative data of change in curl of embodiments of coated abrasive articles 100 of the disclosure. As shown, an increase in the weight of the anti-curl layer 116 reduces the change in curl, regardless of grit size. Thus, change in curl remains relatively independent of grit size of the coated abrasive article 100.

Figure 9:
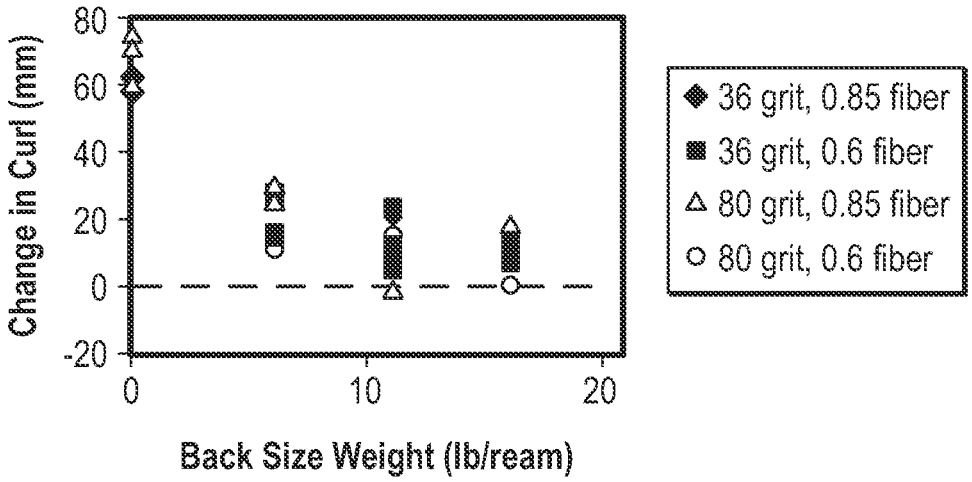
FIG. 9 is a chart providing comparative data of change in curl of embodiments of coated abrasive articles of the disclosure.

FIG. 9 shows a chart providing comparative data of change in curl of embodiments of coated abrasive articles 100 of the disclosure. As shown, change in curl also remains relatively independent of fiber thickness of the coated abrasive article 100.

Figure 10:
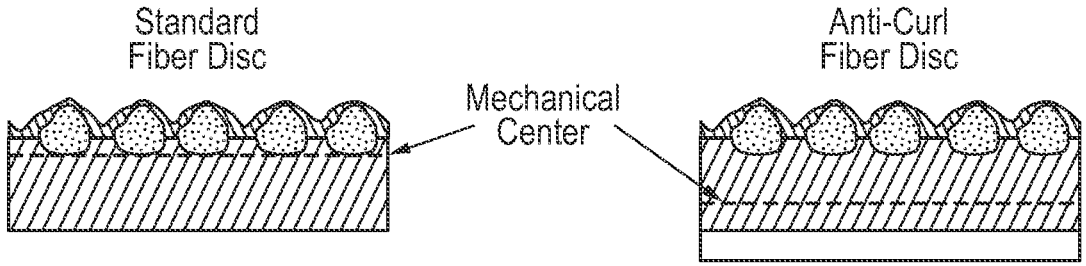
FIG. 10 is a cross sectional view of a conventional abrasive article and an embodiment of an abrasive article having an anti-curl layer.

FIG. 10 shows a cross sectional view of a conventional abrasive article and an embodiment of a coated abrasive article 100 having an anti-curl layer 116. As shown, the addition of the anti-curl layer 116 adjusts the mechanical center of the coated abrasive article 100 within the substrate 102 of the coated abrasive article 100.

Figure 11:
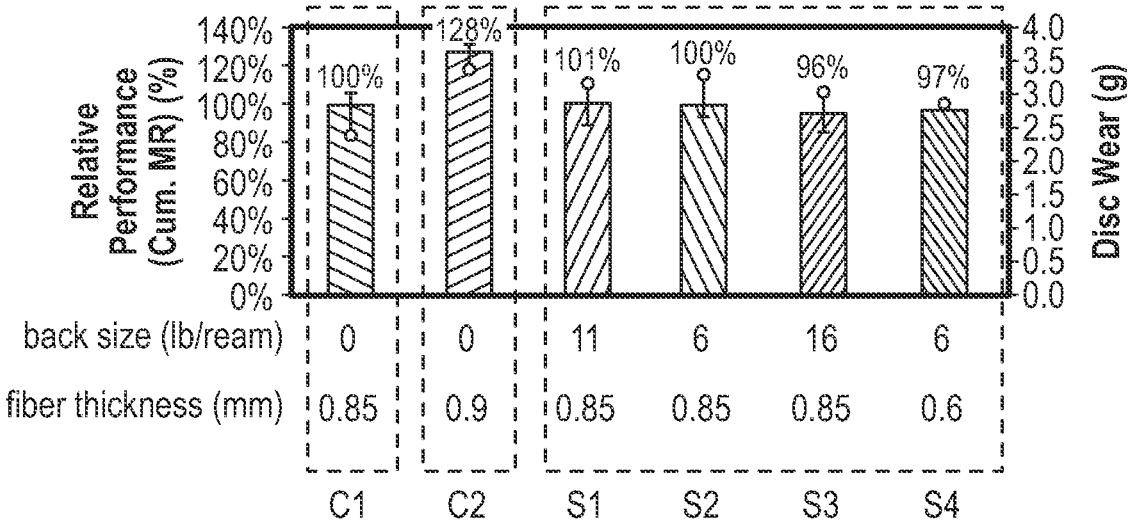
FIG. 11 is a chart providing comparative performance data of conventional abrasive articles and embodiments of coated abrasive articles of the disclosure.

FIG. 11 shows a chart providing comparative performance data of conventional abrasive articles (C1 to C2) and embodiments (S1 to S4) of coated abrasive articles 100 of the disclosure. As shown, C1 and C2 lack an anti-curl layer 116. However, C2 comprises a high performance fiber disc having a larger fiber thickness as compared to C1 and S1 to S4. Surprisingly and beneficially, samples S1 to S4 exhibit substantially no loss of grinding performance as measured by cumulative material removal percentage. While not shown, S1 to S4 also show no loss of burst speed or disc wear as compared to conventional sample C1 that is free of the anti-curl layer 116.

It will be appreciated that embodiments of an abrasive article are disclosed herein that may include one or more of the following embodiments:

Embodiment 1. A coated abrasive article comprising a substrate comprising a plurality of hygroscopic fibers; an abrasive layer disposed on a first side of the substrate; and an anti-curl layer disposed on a second side of the substrate, wherein the coated abrasive article comprises a change in curl between −5 millimeters and 25 millimeters, wherein the change in curl is expressed as the curl of the coated abrasive article in millimeters at 90% relative humidity minus the curl of the coated abrasive article in millimeters at 20% relative humidity.

Embodiment 2. A coated abrasive article comprising a substrate comprising a plurality of hygroscopic fibers; an abrasive layer disposed on a first side of the substrate; and an anti-curl layer disposed on a second side of the substrate, wherein the coated abrasive article comprises a normalized change in curl percentage between −2.8% and 14.1%, wherein the normalized change in curl percentage is expressed as the ratio of the change in curl to the diameter of the coated abrasive article, and wherein the change in curl is expressed as the curl of the coated abrasive article in millimeters at 90% relative humidity minus the curl of the coated abrasive article in millimeters at 20% relative humidity.

Embodiment 3. The coated abrasive article of any of embodiments 1 to 2, wherein the abrasive layer comprises a make coat having a plurality of abrasive particles disposed on or in a polymeric binder.

Embodiment 4. The coated abrasive article of embodiment 3, wherein the abrasive layer comprises a weight of at least 20 lb./ream to not greater than 110 lb./ream.

Embodiment 5. The coated abrasive article of any of embodiments 3 or 4, wherein the polymeric binder comprises phenol formaldehyde, urea formaldehyde, UV-curable polymers, epoxy, acrylic, unsaturated polyester, or a combination thereof.

Embodiment 6. The coated abrasive article of embodiment 5, wherein the abrasive layer comprises a size coat disposed over the make coat, a supersize coat disposed over the size coat, or any combination thereof.

Embodiment 7. The coated abrasive article of any of embodiments 1 to 6, wherein the substrate comprises a thickness, wherein the abrasive layer comprises a thickness, and wherein the thickness of the substrate is at least 200% to not greater than 600% or at least 300% to not greater than 550% of the thickness of the abrasive layer.

Embodiment 8. The coated abrasive article of any of embodiments 1 to 7, wherein the plurality of hygroscopic fibers comprises vulcanized fibers, leatheroid, or a combination thereof.

Embodiment 9. The coated abrasive article of embodiment 8, wherein the vulcanized fibers comprise Commercial Grade vulcanized fibers, Electrical Grade vulcanized fibers, Trunk Grade vulcanized fibers, Bone Grade vulcanized fibers, Wood Laminating Grade vulcanized fibers, or a combination thereof.

Embodiment 10. The coated abrasive article of any of embodiments 1 to 9, wherein the substrate comprises a thickness of at least 0.60 millimeters, at least 0.65 millimeters, at least 0.70 millimeters, at least 0.75 millimeters, at least 0.80 millimeters, at least 0.85 millimeters, at least 0.90 millimeters, or at least 0.95 millimeters.

Embodiment 11. The coated abrasive article of embodiment 10, wherein the substrate comprises a thickness of not greater than 2.00 millimeters, not greater than 1.50 millimeters, not greater than 1.40 millimeters, not greater than 1.30 millimeters, not greater than 1.20 millimeters, not greater than 1.10 millimeters, or not greater than 1.00.

Embodiment 12. The coated abrasive article of any of embodiments 1 to 11, wherein the substrate is free of a reinforcing material.

Embodiment 13. The coated abrasive article of any of embodiments 1 to 12, wherein the anti-curl layer comprises phenol formaldehyde, urea formaldehyde, UV-curable polymers, epoxy, acrylic, unsaturated polyester, latex suspension, fillers, or a combination thereof.

Embodiment 14. The coated abrasive article of embodiment 13, wherein the anti-curl layer consists essentially of phenol formaldehyde and fillers.

Embodiment 15. The coated abrasive article of embodiment 13, wherein the anti-curl layer consists essentially of urea formaldehyde and fillers.

Embodiment 16. The coated abrasive article of any of embodiments 1 to 15, wherein the anti-curl layer comprises a weight of at least 5.0 lb./ream, at least 6.0 lb./ream, at least 7.0 lb./ream, at least 8.0 lb./ream, at least 9.0 lb./ream, at least 10.0 lb./ream, at least 11.0 lb./ream, at least 12.0 lb./ream, at least 13.0 lb./ream, at least 14.0 lb./ream, at least 15.0 lb./ream, or at least 16.0 lb./ream.

Embodiment 17. The coated abrasive article of embodiment 16, wherein the anti-curl layer comprises a weight of not greater than 25.0 lb./ream, not greater than 24.0 lb./ream, not greater than 23.0 lb./ream, not greater than 22.0 lb./ream, not greater than 21.0 lb./ream, or not greater than 20.0 lb./ream.

Embodiment 18. The coated abrasive article of any of embodiments 1 to 17, wherein the anti-curl layer comprises a thickness of at least 0.03 millimeters, at least 0.04 millimeters, at least 0.05 millimeters, at least 0.06 millimeters, at least 0.07 millimeters, or at least 0.075 millimeters.

Embodiment 19. The coated abrasive article of embodiment 18, wherein the anti-curl layer comprises a thickness of not greater than 0.2 millimeters, not greater than 0.15 millimeters, not greater than 0.14 millimeters, not greater than 0.13 millimeters, not greater than 0.12 millimeters, not greater than 0.11 millimeters, not greater than 0.10 millimeters, or not greater than 0.095 millimeters.

Embodiment 20. The coated abrasive article of embodiment 19, wherein the anti-curl layer comprises phenol formaldehyde and a thickness of at least 0.03 millimeters to not greater than 0.06 millimeters.

Embodiment 21. The coated abrasive article of embodiment 19, wherein the anti-curl layer comprises urea formaldehyde and a thickness of at least 0.07 millimeters to not greater than 0.175 millimeters.

Embodiment 22. The coated abrasive article of any of embodiments 1 to 21, wherein the abrasive layer comprises a weight of a make coat and at least one size coat, wherein the anti-curl layer comprises a weight, and wherein the ratio of the weight of the anti-curl layer is at least 10% to 100%, at least 12% to not greater than 75%, or at least 15% to not greater than 55% of the weight of the make and size coats of the abrasive layer.

Embodiment 23. The coated abrasive article of embodiment 22, wherein the abrasive layer comprises a weight of phenol formaldehyde polymer, wherein the anti-curl layer comprises a weight of phenol formaldehyde polymer, and the ratio of the weight of the phenol formaldehyde-containing anti-curl layer is at least 8% to not greater than 45% or at least 16% to not greater than 25% of the weight of the make and size coats of the abrasive layer.

Embodiment 24. The coated abrasive article of embodiment 22, wherein the abrasive layer comprises a weight of phenol formaldehyde polymer, wherein the anti-curl layer comprises a weight of urea formaldehyde polymer, and the ratio of the weight of the urea formaldehyde-containing anti-curl layer is at least 10% to not greater than 100% or at least 15% to not greater than 60% of the weight of the make and size coats of the abrasive layer.

Embodiment 25. The coated abrasive article of any of embodiments 1 to 24, wherein the abrasive layer comprises a total weight of a make coat, at least one size coats, and abrasive grains, wherein the anti-curl layer comprises a total weight, and wherein the ratio of the total weight of the anti-curl layer is at least 3% to not greater than 35%, at least 5% to not greater than 30%, or at least 8% to not greater than 20% of the total weight of the total abrasive layer.

Embodiment 26. The coated abrasive article of any of embodiments 1 to 25, wherein the anti-curl layer contains calcium sulfate, talc, wollastonite, calcium silicate, cryolite, alumina trihydrate, fumed silica, clay, or calcium carbonate fillers or is free of an additional reinforcing material.

Embodiment 27. The coated abrasive article of any of embodiments 1 to 26, wherein the anti-curl layer adjusts the mechanical center of the coated abrasive article to be between a central 50% of the substrate.

Embodiment 28. The coated abrasive article of any of embodiments 1 to 27, wherein the coated abrasive article comprises a circular disc shape.

Embodiment 29. The coated abrasive article of any of embodiments 1 to 28, wherein the coated abrasive article exhibits substantially no loss of grinding performance, burst speed, or a combination thereof as compared to a coated abrasive article free of the anti-curl layer.

Embodiment 30. A method of forming a coated abrasive article comprising forming a substrate from a plurality of hygroscopic fibers; disposing an abrasive layer on one side of the substrate; and disposing an anti-curl layer on a second side of the substrate, wherein the coated abrasive article comprises a change in curl of not less than −5 millimeters to not greater than 25 millimeters, wherein the change in curl is expressed as the curl of the coated abrasive article in millimeters at 90% relative humidity minus the curl of the coated abrasive article in millimeters at 20% relative humidity.

Embodiment 31. A method of forming a coated abrasive article comprising: forming a substrate from a plurality of hygroscopic fibers; disposing an anti-curl layer on a second side of the substrate, wherein the coated abrasive article comprises a change in curl of not less than −5 millimeters to not greater than 25 millimeters, wherein the change in curl is expressed as the curl of the coated abrasive article in millimeters at 90% relative humidity minus the curl of the coated abrasive article in millimeters at 20% relative humidity; and disposing an abrasive layer on one side of the substrate.

Embodiment 32. A method of forming a coated abrasive article comprising forming a substrate from a plurality of hygroscopic fibers; disposing an abrasive layer on one side of the substrate; and disposing an anti-curl layer on a second side of the substrate, wherein the coated abrasive article comprises a change in curl percentage of not less than −0.36% to not greater than 17.9%, wherein the change in curl percentage is expressed as the ratio of the change in curl to the diameter of the coated abrasive article expressed as a percentage, and wherein the change in curl is expressed as the curl of the coated abrasive article in millimeters at 90% relative humidity minus the curl of the coated abrasive article in millimeters at 20% relative humidity.

Embodiment 33. The method of any of embodiments 30 to 32, wherein the plurality of hygroscopic fibers comprises vulcanized fibers, leatheroid, or a combination thereof.

Embodiment 34. The method of any of embodiments 30 to 33, wherein the anti-curl layer comprises phenol formaldehyde, urea formaldehyde, UV-curable polymers, epoxy, acrylic, unsaturated polyester, latex suspension, or a combination thereof.

Embodiment 35. The method of any of embodiments 30 to 34, wherein the substrate and the anti-curl layer are free of an additional reinforcing material.

Embodiment 36. The method of any of embodiments 30 to 35, wherein the abrasive layer comprises a make coat having a plurality of abrasive particles disposed on or in a polymeric binder.

Embodiment 37. The method of embodiment 36, further comprising disposing a size coat over the make coat.

Embodiment 38. The method of embodiment 37, further comprising: disposing a supersize coat over the size coat.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A coated abrasive article comprising:

a substrate comprising a plurality of hygroscopic fibers;

an abrasive layer disposed on a first side of the substrate; and an anti-curl layer disposed on a second side of the substrate, wherein the coated abrasive article comprises a change in curl between −5 millimeters and 25 millimeters, wherein the change in curl is expressed as the curl of the coated abrasive article in millimeters at 90% relative humidity minus the curl of the coated abrasive article in millimeters at 20% relative humidity, wherein the anti-curl layer comprises a weight of at least 9.0 lb./ream and not greater than 25 lb./ream, wherein the anti-curl layer comprises a majority of urea-formaldehyde, and wherein the abrasive layer comprises a weight of phenol formaldehyde polymer, and the ratio of the weight of the urea formaldehyde polymer of the anti-curl layer is at least 10% to not greater than 100% of the weight of the phenol formaldehyde polymer of the abrasive layer.

2. The coated abrasive article of claim 1, wherein the coated abrasive article comprises a normalized change in curl percentage between −2.8% and 14.1%.

3. The coated abrasive article of claim 1, wherein the abrasive layer comprises a make coat having a plurality of abrasive particles disposed on or in a polymeric binder comprising phenol formaldehyde, urea formaldehyde, UV-curable polymers, epoxy, acrylic, unsaturated polyester, or a combination thereof.

4. The coated abrasive article of claim 3, wherein the abrasive layer comprises a size coat disposed over the make coat, a supersize coat disposed over the size coat, or any combination thereof.

5. The coated abrasive article of claim 1, wherein the plurality of hygroscopic fibers comprises vulcanized fibers, leatheroid, or a combination thereof.

6. The coated abrasive article of claim 1, wherein the substrate comprises a thickness of at least 0.60 millimeters.

7. The coated abrasive article of claim 6, wherein the substrate comprises a thickness of not greater than 2.00 millimeters.

8. The coated abrasive article of claim 1, wherein the anti-curl layer further comprises, UV-curable polymers, epoxy, acrylic, unsaturated polyester, latex suspension, fillers, or a combination thereof.

9. The coated abrasive article of claim 1, wherein the anti-curl layer further comprises essentially of urea formaldehyde and fillers.

10. The coated abrasive article of claim 1, wherein the anti-curl layer comprises a weight of at least 10.0 lb./ream.

11. The coated abrasive article of claim 1, wherein the anti-curl layer comprises a thickness of at least 0.03 millimeters.

12. The coated abrasive article of claim 11, wherein the anti-curl layer comprises a thickness of not greater than 0.2 millimeters.

13. The coated abrasive article of claim 12, wherein the thickness of the anti-curl layer is not greater than 0.06 millimeters.

14. The coated abrasive article of claim 12, wherein the anti-curl layer comprises a thickness of at least 0.07 millimeters to not greater than 0.175 millimeters.

15. The coated abrasive article of claim 1, wherein the abrasive layer comprises a weight of a make coat and a size coat, wherein the anti-curl layer comprises a weight, and wherein the ratio of the weight of the anti-curl layer is at least 10% to 100% of the weight of the make and size coats of the abrasive layer.

16. The coated abrasive article of claim 15, wherein the abrasive layer comprises a weight of phenol formaldehyde polymer, and the ratio of the weight of the urea formaldehyde-containing anti-curl layer is at least 10% to not greater than 100% of the weight of the make and size coats of the abrasive layer.

17. The coated abrasive article of claim 1, wherein the anti-curl layer adjusts the mechanical center of the coated abrasive article to be between a central 50% of the substrate.

* * * * *